US005259320A

United States Patent [19]

Brooks

[11] Patent Number: 5,259,320

[45] Date of Patent: Nov. 9, 1993

[54] INTERMEDIATE ARTICLE USED TO FORM A BULLET PROJECTILE OR COMPONENT AND A FINALLY FORMED BULLET

[75] Inventor: Randy C. Brooks, Highland, Utah

[73] Assignee: Barnes Bullets, Inc., American Fork, Utah

[21] Appl. No.: 974,319

[22] Filed: Nov. 10, 1992

Related U.S. Application Data

[60] Continuation of Ser. No. 798,076, Nov. 20, 1991, abandoned, which is a division of Ser. No. 372,992, Jun. 29, 1989, Pat. No. 5,131,123.

[51] Int. Cl.[5] ..... F42B 12/34

[52] U.S. Cl. ..... 102/509; 102/501

[58] Field of Search ..... 102/501, 507-510, 102/398; 29/1.2-1.23

[56] References Cited

U.S. PATENT DOCUMENTS

| | | | |
|---|---|---|---|
| 1,059,213 | 4/1913 | Ross . | |
| 1,095,501 | 5/1914 | Hoagland . | |
| 1,135,357 | 4/1915 | Clyne | 102/510 |
| 1,556,160 | 10/1925 | Riggs . | |
| 1,833,127 | 11/1931 | Rinkel . | |
| 2,045,964 | 6/1936 | Rinkel | 29/1.22 X |
| 2,123,981 | 7/1938 | Whipple . | |
| 2,327,950 | 8/1943 | Whipple | 29/1.23 |
| 2,765,738 | 10/1956 | Frech, Jr. | 29/123 |
| 3,003,420 | 10/1961 | Nasler . | |
| 3,157,137 | 11/1964 | Burns, Jr. | 102/509 |
| 4,044,685 | 8/1977 | Avcin . | |
| 4,245,557 | 1/1991 | Knappworst . | |
| 4,550,662 | 11/1985 | Burczynski . | |
| 4,655,140 | 4/1987 | Schirneker . | |
| 5,101,732 | 4/1992 | Schluckebier | 102/509 |

FOREIGN PATENT DOCUMENTS 5230 of 1885 United Kingdom ..... 102/507

OTHER PUBLICATIONS

"Styles In Small Arms Projectiles" by Green Army Ordnance May-Jun. 1932, pp. 395-401.

*Primary Examiner*—Harold J. Tudor

*Attorney, Agent, or Firm*—Diller, Ramik & Wright

[57] ABSTRACT

A bullet is manufactured by providing a slug of metal having an end face and applying an axial force against the end face of sufficient magnitude to form an axially outwardly opening first cavity. Thereafter a second force is applied against the first cavity to reform the first cavity into a second cavity having a peripheral edge of a generally scalloped configuration and an interior surface defining tears of alternating triangular flat faces set-off by edges converging toward a blind end of the cavity. The end portion is then contoured into a generally convex curvature which constricts the scalloped peripheral edge and transforms the triangular faces into radially inwardly directed ribs and alternating lines of weakness which, upon bullet impact, control radial expansion and axial tearing of petals formed during impact which creates maximum hydraulic shock in the absence of fragmentation which in turn ensures humane killing of game.

16 Claims, 11 Drawing Sheets

FIG. 1
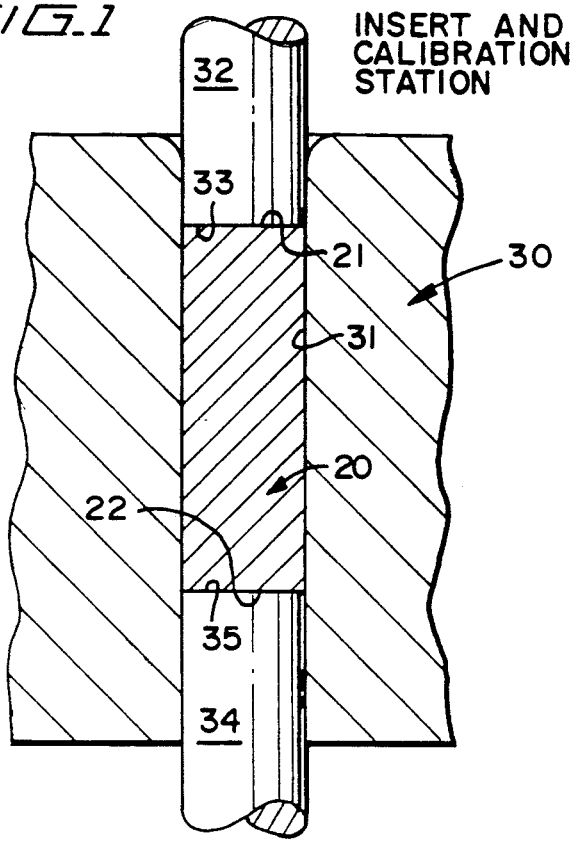
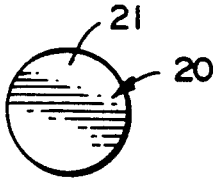
FIG. 2
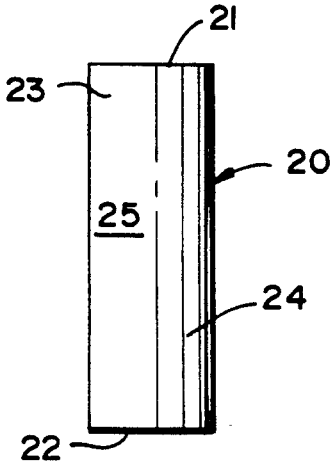
FIG. 3
FIG. 4
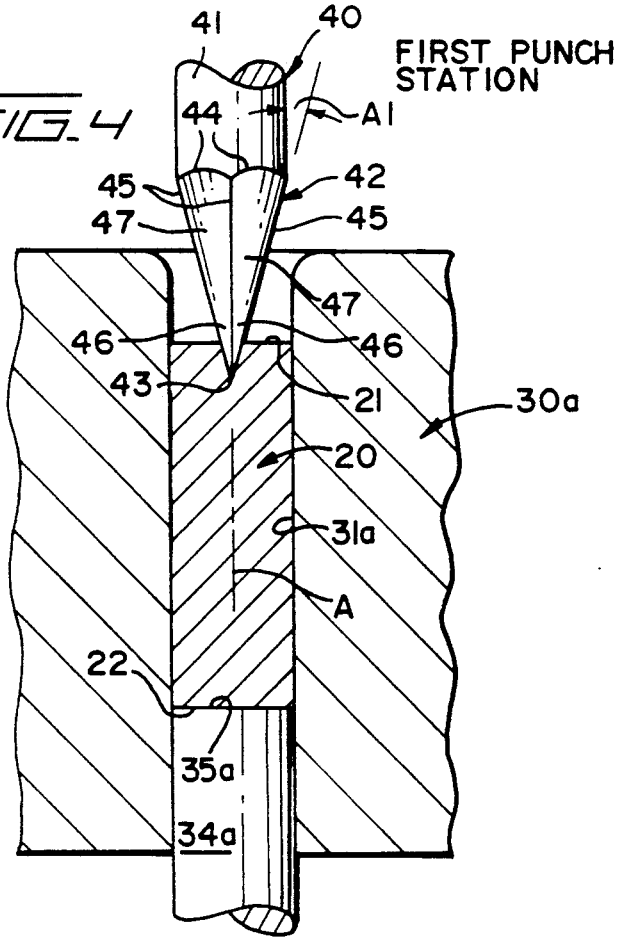
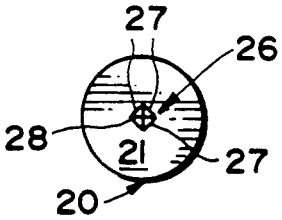
FIG. 5
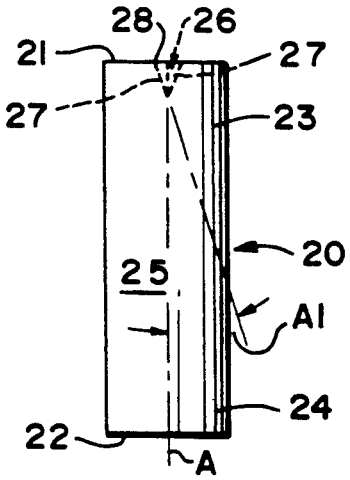
FIG. 6

FIG. 7
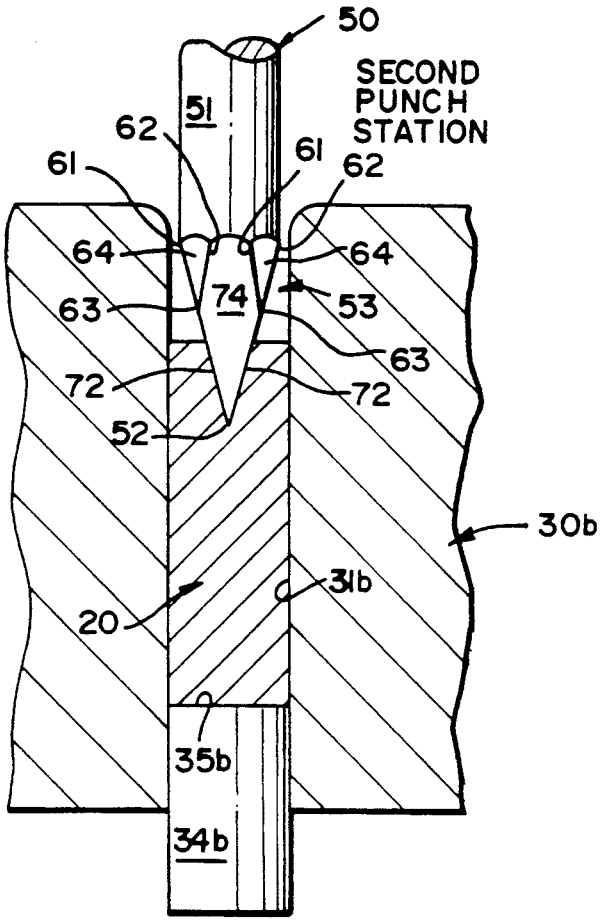
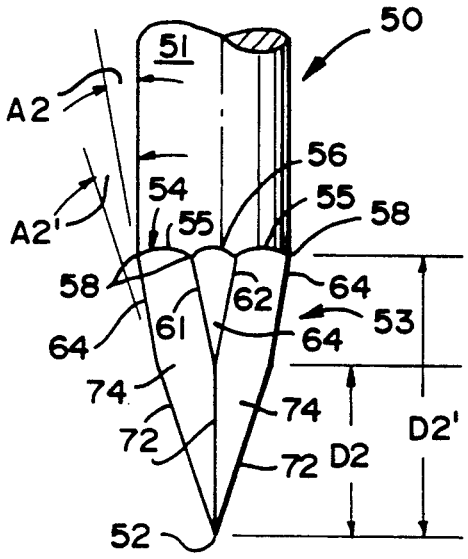
FIG. 10
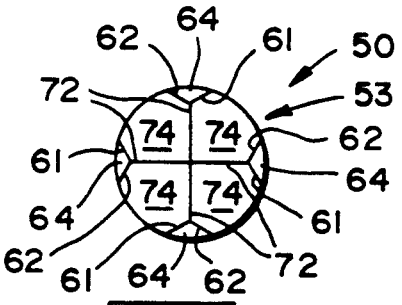
FIG. 11
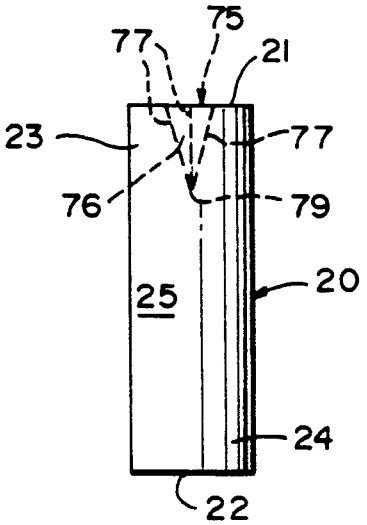
FIG. 8
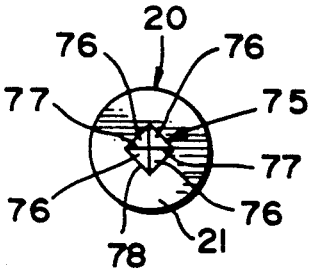
FIG. 9

FIG. 12
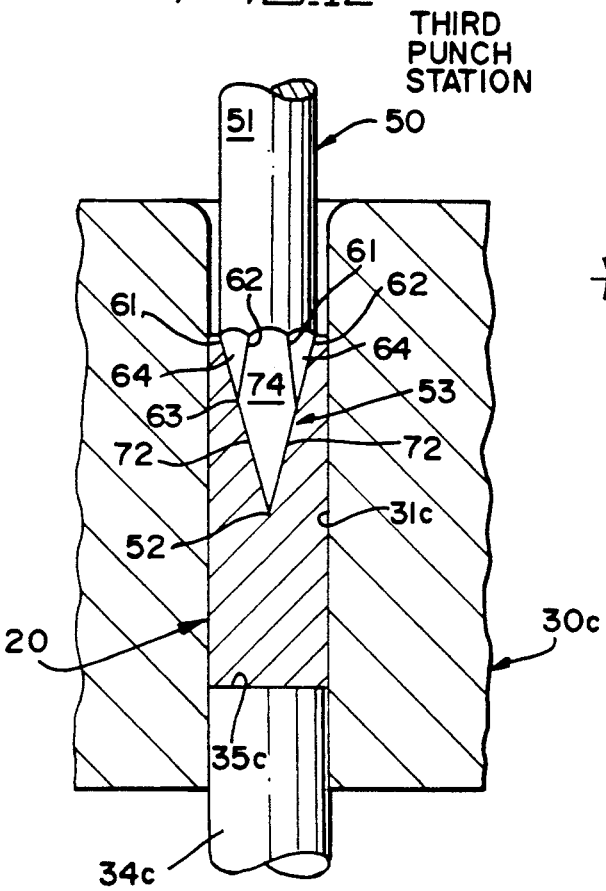
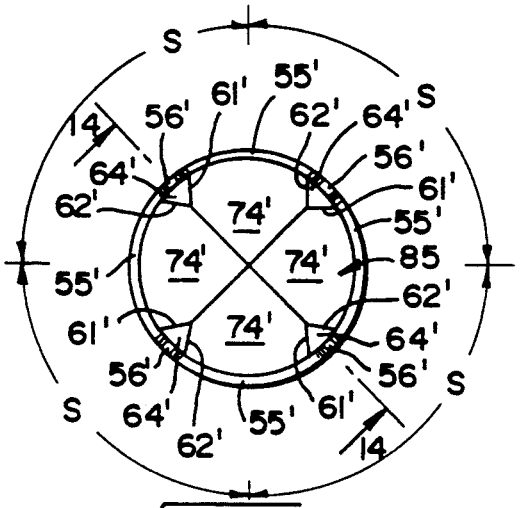
FIG. 13
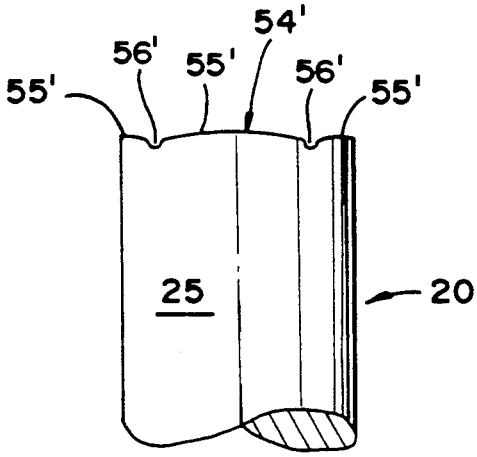
FIG. 15
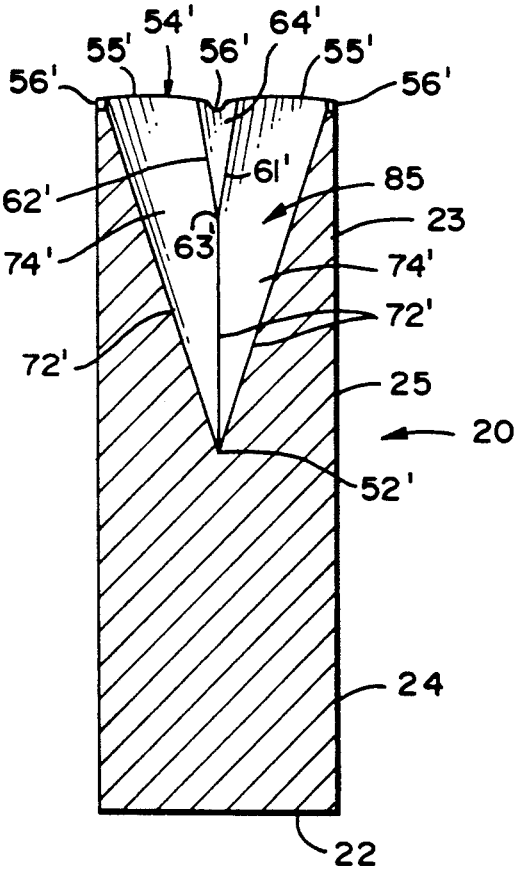
FIG. 14

FIG. 16
FOURTH PUNCH STATION
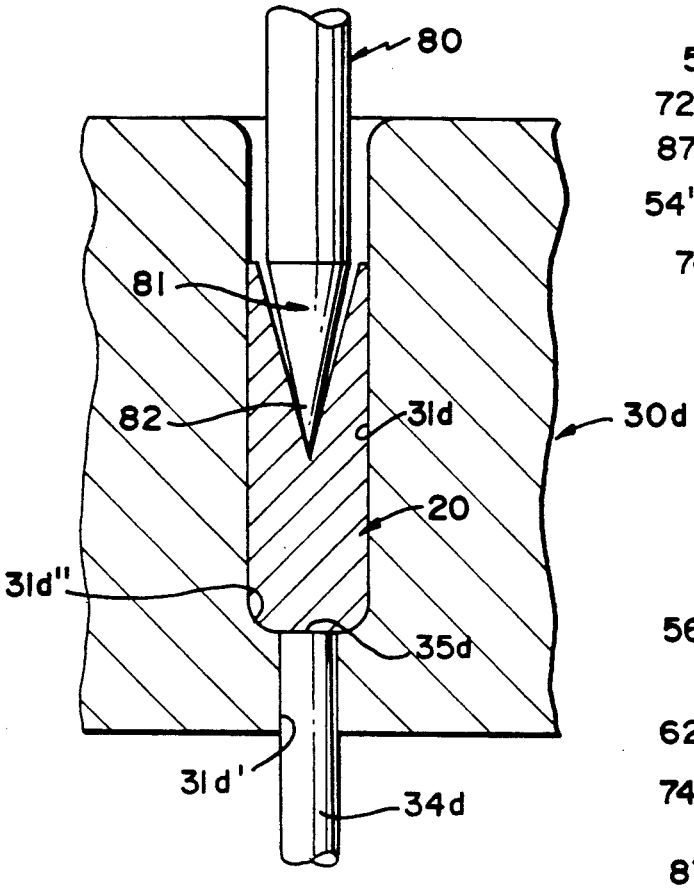
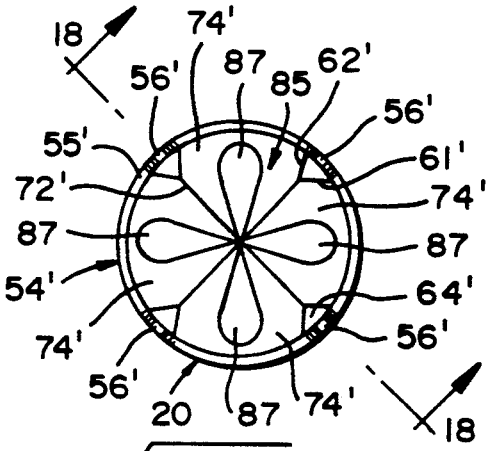
FIG. 17
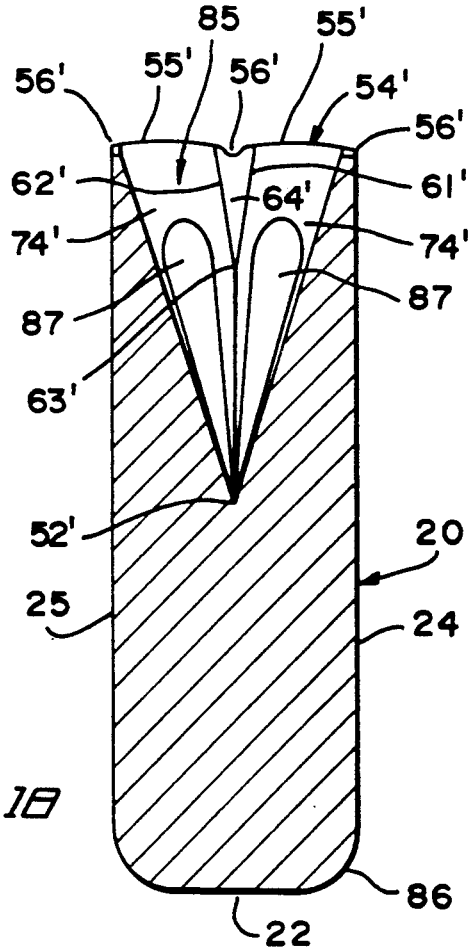
FIG. 18

FIG. 19
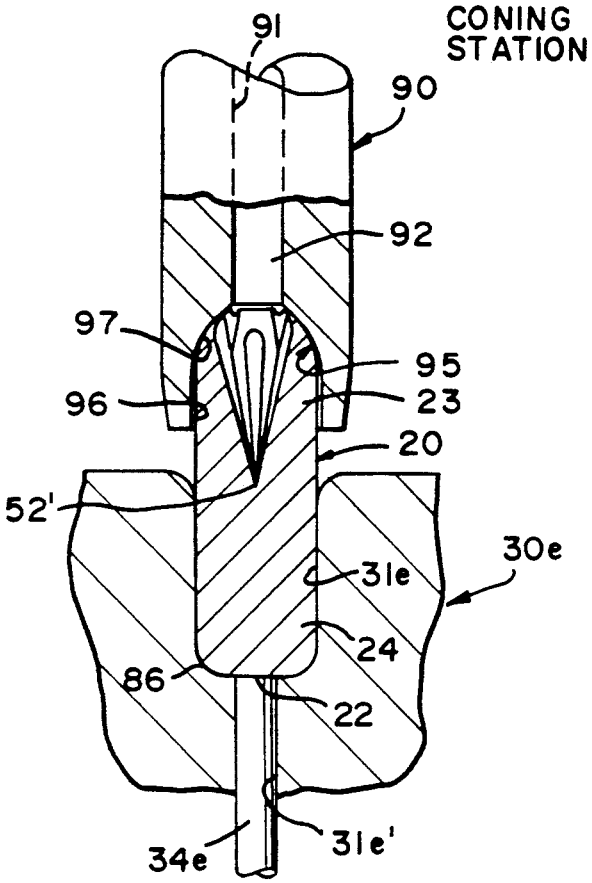
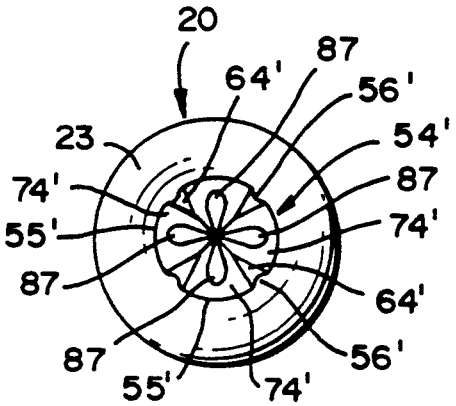
FIG. 20
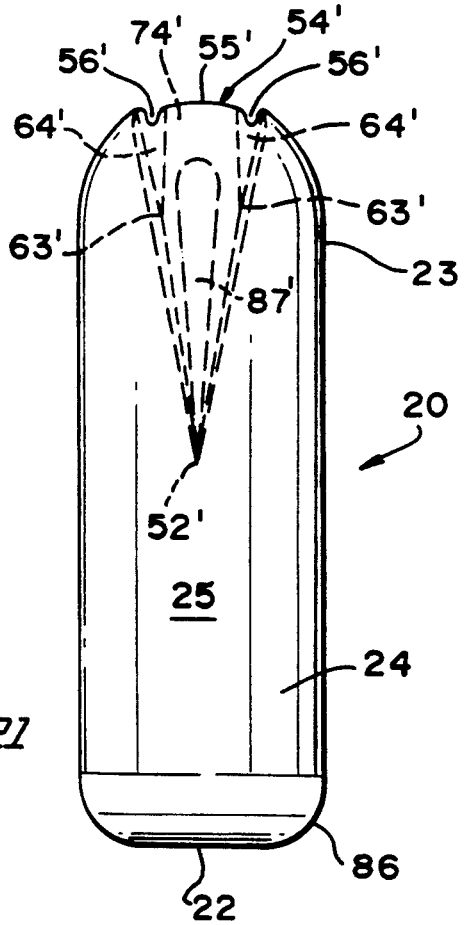
FIG. 21

REINSERT STATION

OGIVE STATION

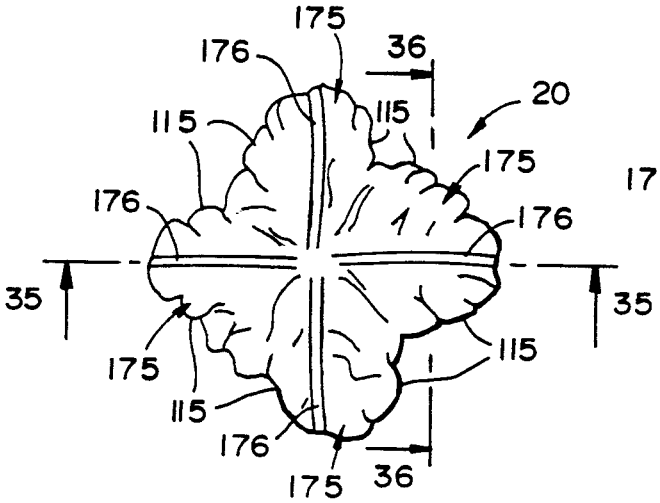
FIG. 34
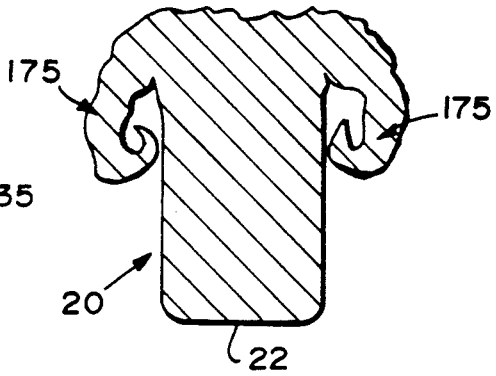
FIG. 35
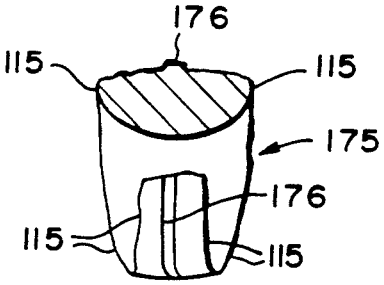
FIG. 36
FIG. 37
FIRST PUNCH STATION
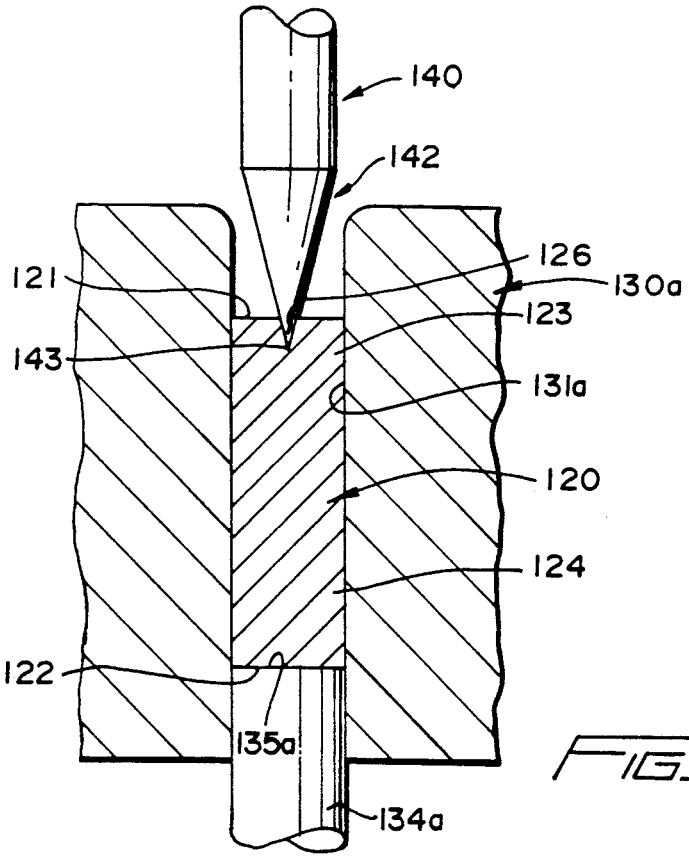
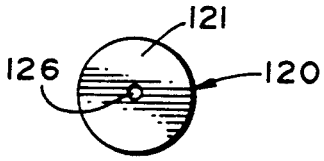
FIG. 38
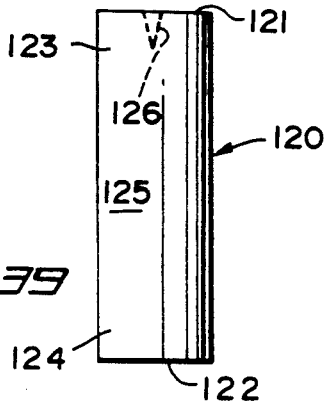
FIG. 39

INTERMEDIATE ARTICLE USED TO FORM A BULLET PROJECTILE OR COMPONENT AND A FINALLY FORMED BULLET

This application is a continuation of application Ser. No. 07/798,076, filed Nov. 20, 1991, now abandoned, which is a divisional application of 07/372,992 of Jun. 29, 1989, now U.S. Pat. No. 5,131,123 of Jul. 21, 1992.

BACKGROUND OF THE INVENTION

The invention is directed to a novel bullet and methods of manufacturing a bullet of the type which will mushroom or expand upon impact.

DESCRIPTION OF RELATED ART

U.S. Pat. No. 3,157,137 issued on Nov. 17, 1964 to Arthur H. Burns., Jr. discloses an expanding point bullet, known as a mushrooming bullet, and the method of manufacture thereof. The bullet is fabricated by first performing a cupping operation to make a cup from desired base jacket materials assembling a slug or particles of core material into the jacket cup, pressing or compressing the core material in the cup, edge-creasing circumferential spaced indentations adjacent the open edge of the cup, and thereafter swaging the creased assembly to finish the bullet's shape at its tip or nose. This process is relatively time-consuming and expensive because two different bullet parts, namely, the base jacket and the slug or core material must first be made, assembled, and thereafter formed or contoured to complete the fabrication. Obviously, the bullet lacks homogeneity which in turn reduces desired ballistic performance, accuracy, and controlled mushrooming or expansion.

U.S. Pat. No. 4,044,685 issued Aug. 30, 1977 to France Avcia discloses a hunting bullet which is also made of two parts and attempts to fulfill the conditions expressed in the first column of this patent, paragraphs a. through f. thereof. The bullet includes a cup-shaped body having a hollow cylindrical space into which project along the length thereof a number of notches formed in angularly equally spaced relationship parallel to the axis of the bullet. The hollow space houses a cylindrical filling having a rounded tip and upon impact, the head assumes a "crown cutter" configuration with the parts between the notches rolled into so-called "flags." Such impact expands or mushrooms the projectile and mashes the latter or plastic filling in hoped-for avoidance of splintering. Obviously, manufacturing presents a very serious problem, particularly since the patent truly does not advise one skilled in the art as to how the notches are formed in the inner surface of the hollow space. Suffice it to say that machining might be apparent but would be difficult and expensive as would, of course, the additional prerequisite of assembling the filling to the bullet body or jacket. The two piece construction lacks homogeneity earlier-noted and necessarily results in a bullet less than capable of fulfilling the conditions aspired to by the patentee.

U.S. Pat. No. 1,095,501 issued May 5, 1914 to Frank O. Hoagland discloses a bullet formed from a generally cup-shaped slug having a recess whose configuration is said not to be the essence of the invention. This slug is swaged at its forward end to the desired tapering form by means of a corrugated die which forms a series of alternating longitudinal ribs and depressions which converge toward the tip. The tip may be entirely closed, or provided with an opening and a flashing compound is introduced into the recess to serve as an illuminating bullet. The longitudinal grooves and depressions are said to greatly assist in the mushrooming of the bullet.

U.S. Pat. No. 4,550,662 issued on Nov. 5, 1985 to Thomas J. Burczynski, and discloses another hollow-point bullet formed of two parts with the bullet body having a central cavity with an enlarged opening at one end and a blind end opposite thereto. A series of tapered wedges or rib members are formed in the cavity by a swaging die utilizing a specially grooved nose punch to form the longitudinal flutes of the cavity and the surfaces of the ribs.

U.S. Pat. No. 4,655,140 issued Apr. 7, 1987 to Hans-Ludwig Schirneker and discloses a bullet or projectile having a blind hole in its center tapering and enlarging toward the bullet tip. In one embodiment, internal grooves are applied to the wall of the cavity which, in conjunction with exterior obliquely arranged notches, facilitates mushrooming of the bullet.

The latter are representative patents of bullets or projectiles which expand or mushroom upon impact, and others of comparable content include U.S. Pat. No. 1,556,160 issued Oct. 6, 1925 to Roy F. Riggs; U.S. Pat. No. 4,245,557 issued Jan. 20, 1981 to Jurgen Knappworst et al.; U.S. Pat. No. 1,135,357 issued Apr. 13, 1915 to R. C. Clyne; U.S. Pat. No. 2,123,981 issued Jul. 19, 1938 to E. G. Whipple; U.S. Pat. No. 1,833,127 issued Nov. 24, 1931 to O. Rinkel; U.S. Pat. No. 3,003,420 issued Oct. 10, 1961 to J. A. Nosler; and U.S. Pat. No. 1,059,213 issued Apr. 15, 1913 to Charles H.A.F.L. Ross.

SUMMARY OF THE INVENTION

In keeping with the foregoing, a primary object of the present invention is to provide a novel bullet which overcomes the disadvantages of prior art mushrooming or expanding bullets of the type mentioned heretofore by providing a novel bullet with an axial cavity manufactured by a novel method to create a highly homogeneous bullet of uniform mass distribution, optimum center of balance, and optimum rotation symmetry to collectively assure improved projectory and kill characteristics even at low velocity (maximum range).

Furthermore, the novel bullet includes in association with its axial cavity, means in the form of a plurality of radially inwardly projecting circumferentially adjoining and longitudinally extending ribs disposed along an inner peripheral portion of the cavity below a terminal tip edge and above a blind end for controlling radial expansion of petals formed during bullet impact and expansion/mushrooming. The latter controlled radial expansion is also achieved in conjunction with another plurality of circumferentially spaced axial extending weakening means disposed one each between the radial expansion controlling ribs for controlling axial tearing of the petals during bullet impact which creates maximum hydraulic shock in the absence of fragmentation which insures humane killing of game.

In further accordance with the invention the novel bullet is produced by providing a slug of generally solid material having an end portion terminating in an end face, applying force against the end face of sufficient magnitude to form an axially outwardly opening cavity therein in part defined by a generally undulating peripheral edge, and contouring the end portion to impart a generally convex curvature thereto while constricting the peripheral edge. Preferably the undulating peripheral edge is of a generally scalloped configuration defined by alternating convex edge portions and concave edge portions with the convex edge portions defining bases of triangular inner surface portions whose apexes project toward and merge at a blind end of the axial cavity. The method of forming the axial cavity utilizes a series of punches with appropriately contoured ends, and in keeping with the two preferred embodiments of the invention, a final forming punch includes a single series of generally triangular faces or surfaces and in another embodiment the punch includes two series of triangular shaped faces or surfaces in at least partial alternating relationship about an exterior periphery of the punch to form mirror surfaces in the bullet cavity.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is an enlarged fragmentary schematic view of a punch, die and slug or bullet body at an insert and calibration station, and illustrates a working position of the punch and die relative to the bullet body.

FIG. 2 is a top plan view of the bullet body of FIG. 1.

FIG. 3 is a side elevational view of the bullet body of FIG. 2.

FIG. 4 is an enlarged fragmentary schematic view of a punch, die and the bullet body at a first punch station, and illustrates a working position of the punch and die relative to the bullet body, and the formation of a relatively shallow axially-outwardly opening cavity of the bullet body.

FIG. 5 is a top plan view of the bullet body of FIG. 4.

FIG. 6 is a side elevational view of the bullet body of FIG. 5.

FIG. 7 is an enlarged fragmentary schematic view of a punch, die and the bullet body at a second punch station, and illustrates a working position of the punch and die at which the cavity of the bullet body of FIGS. 5 and 6 is reformed into a generally deeper cavity.

FIG. 8 is a side elevational view of the bullet body of FIG. 7.

FIG. 9 is a top plan view of the bullet body of FIG. 8.

FIG. 10 is a side elevational view of the punch of FIG. 7, rotated 90 degrees therefrom.

FIG. 11 is a bottom end view looking upwardly in FIG. 10 of the punch tereof.

FIG. 12 is an enlarged fragmentary schematic view of the punch, die and bullet body of FIGS. 8 and 9 at a third punch station, and illustrates the further axial lengthening and contouring of the axial cavity and the formation of a scalloped terminal edge.

FIG. 13 is a top plan view of the bullet body of FIG. 14.

FIG. 14 is an enlarged cross-sectional view taken through the axis of the bullet body of FIG. 13 along line 14—14 thereof.

FIG. 15 is a fragmentary side-elevational view of an upper portion of the bullet body of FIG. 14.

FIG. 16 is an enlarged fragmentary schematic view of another punch, die and the bullet body of FIGS. 13 through 15 at a fourth punch station, and illustrates the contouring of a base of the bullet body.

FIG. 17 is a top plan view of the bullet body of FIG. 18.

FIG. 18 is a cross-sectional view taken along line 18—18 of the bullet body of FIG. 17.

FIG. 19 is an enlarged fragmentary schematic view of another punch and die, and the bullet body of FIGS. 17 and 18 transferred thereto at a coning station, and illustrates a working position of the punch and die at which a top end portion of the bullet body is partially constricted axially inwardly.

FIG. 20 is a top plan view of the bullet body of FIG. 21.

FIG. 21 is a side elevational view of the bullet body of FIG. 20.

FIG. 34 is an end view looking downwardly at the bullet after it has impacted and expanded or mushroomed, and illustrates the formation of four "petals"

during the mushrooming and the general uniformity and symmetry thereof.

FIG. 35 is a cross-sectional view taken generally along line 35—35 of FIG. 34, and illustrates two of the four petals.

FIG. 36 is a cross-sectional view taken generally along line 36—36 of FIG. 34, and illustrates the generally uniform transverse cross-section of one of the petals.

FIG. 37 is an enlarged fragmentary schematic view of another punch and die of another embodiment of the invention associated with a slug or bullet body, and illustrates a working position thereof corresponding to FIG. 4.

FIG. 38 is a top plan view of the bullet body of FIG. 36, and illustrates a conical cavity therein.

FIG. 39 is a side elevational view of the bullet of FIG. 38.

Figure 40:
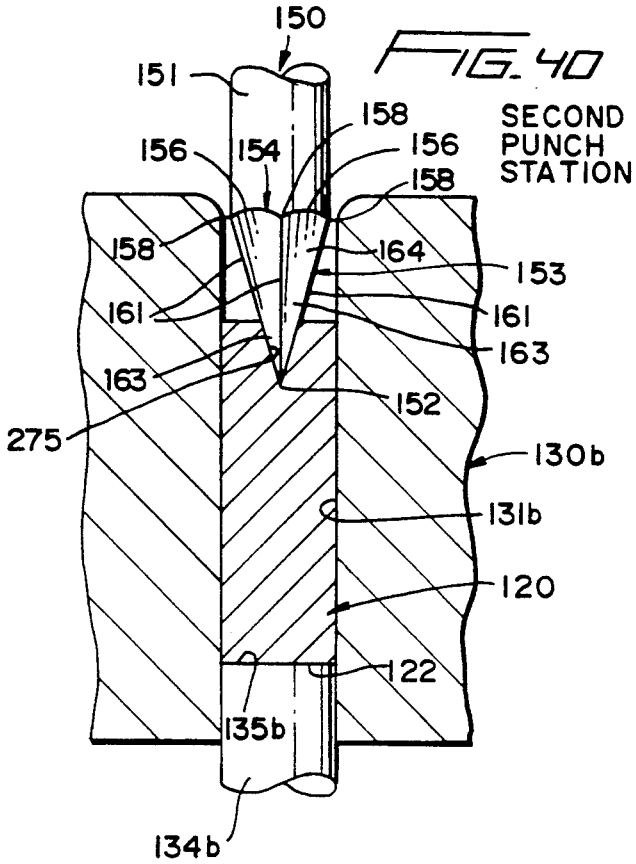

FIG. 40 is an enlarged fragmentary schematic view of another punch and die of the modification of the invention, and illustrates a working position thereof corresponding to FIG. 7.

Figure 41:
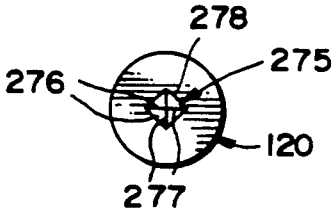
Figure 42:
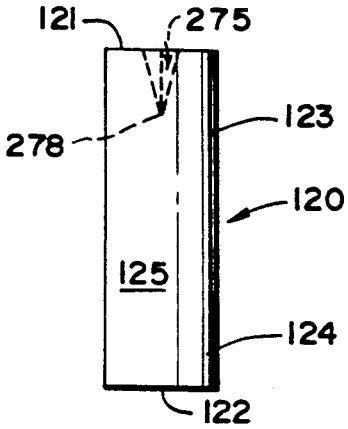

FIG. 41 is a top plan view of the bullet body of FIG. 42.

FIG. 42 is a side elevational view of the bullet body of FIG. 41.

Figure 43:
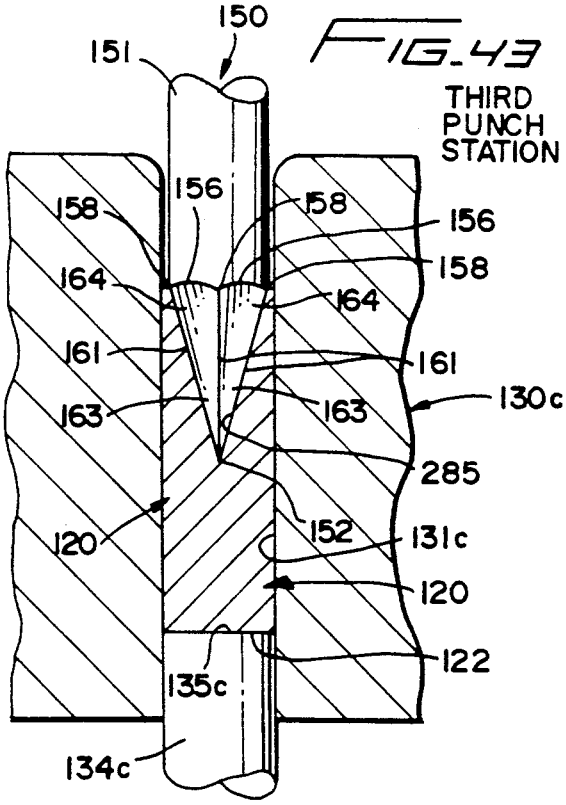

FIG. 43 is an enlarged fragmentary schematic view of the punch of FIG. 40, and illustrates the punch at another station corresponding to the working position of FIG. 12.

Figure 44:
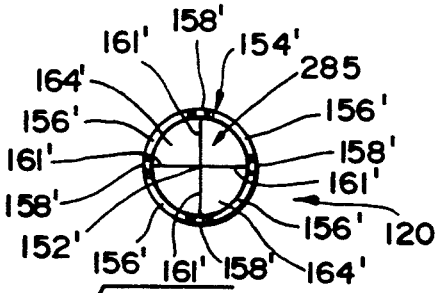
Figure 45:
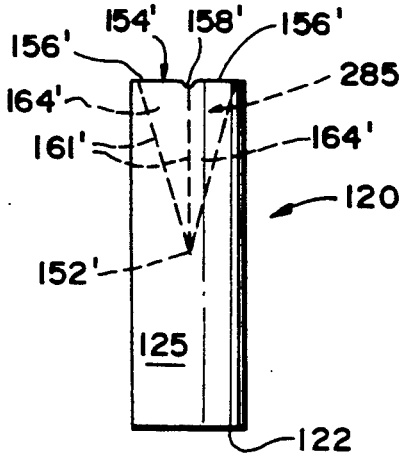

FIG. 44 is a top plan view of the bullet body of FIG. 45.

FIG. 45 is a side elevational view of the bullet body of FIG. 44.

Figure 46:
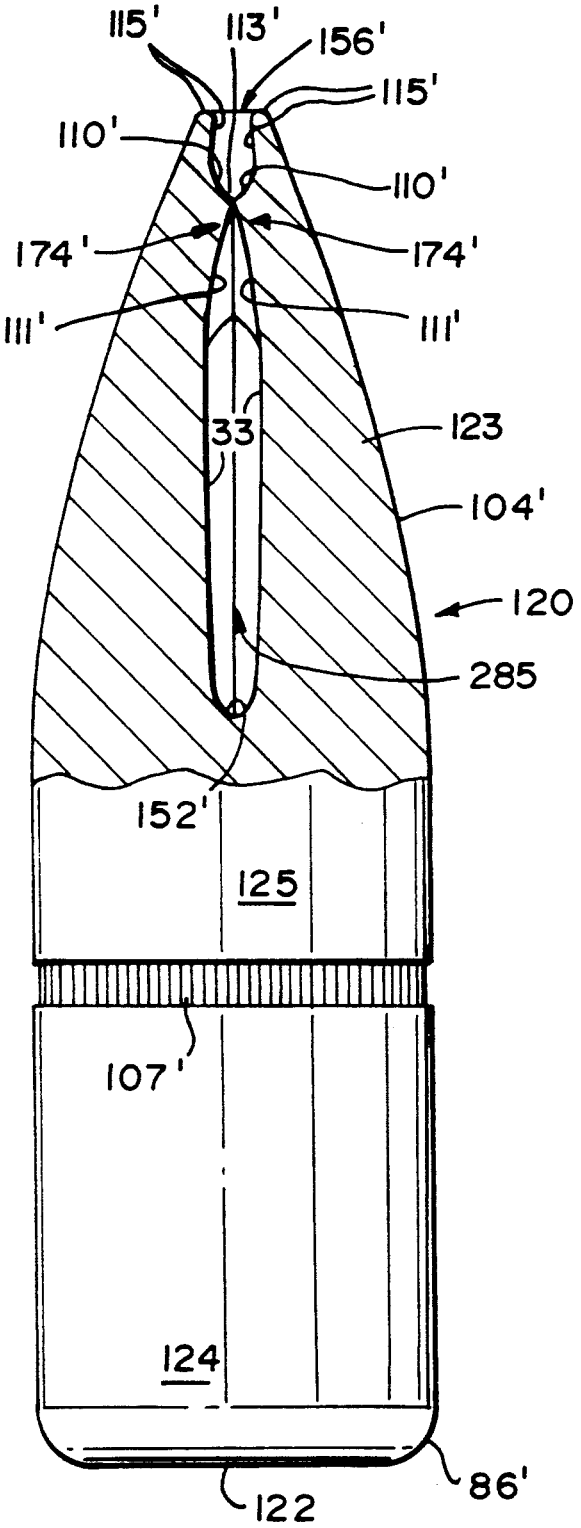

FIG. 46 is an enlarged side-elevational view partially in axial cross-section of the bullet manufactured in accordance with the punches and dies of FIGS. 37, 40 and 43, and illustrates a set of peripherally alternating, axial extending reinforcing ribs and lines of weakness within the axial cavity of the bullet.

Figure 47:
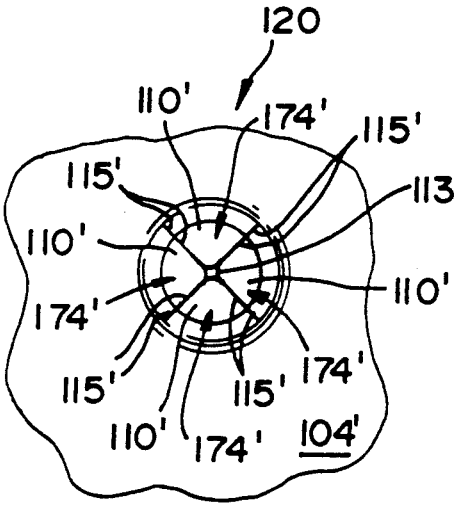

FIG. 47 is a top plan view looking downwardly in FIG. 46, and illustrates the reinforcing ribs and weakening lines and the alternating relationship thereof.

DESCRIPTION OF THE PREFERRED EMBODIMENTS

Figure 31:
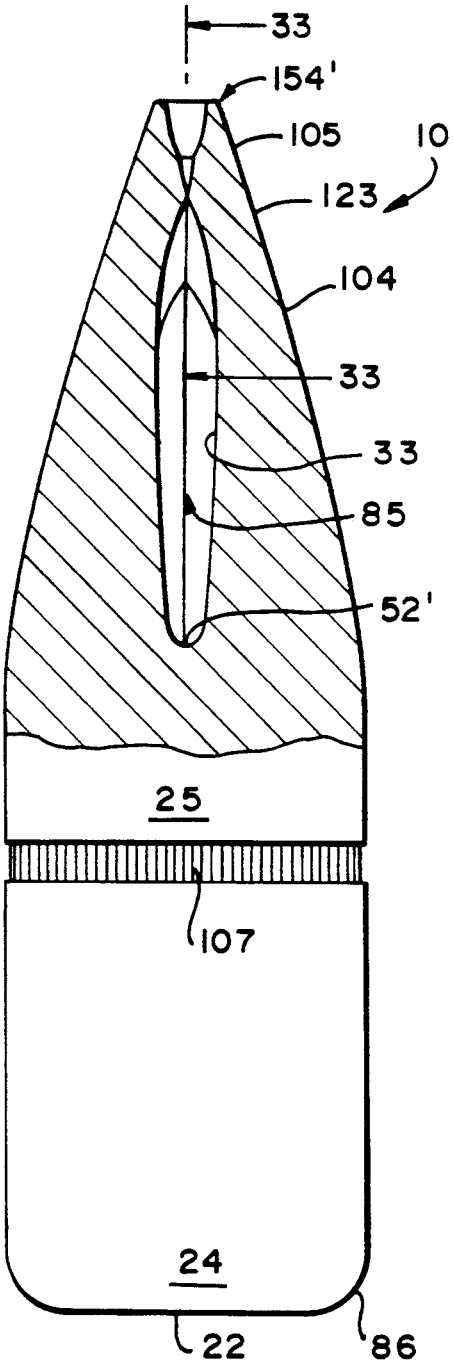
FIG. 31 is an enlarged side elevational view partially in axial cross-section of the bullet manufactured in accordance with the punches and dies of FIGS. 1, 4, 7, 12, 16, 19, 22, 23, 26 and 29, and illustrates a set of peripherally alternating, axially extending reinforcing ribs and lines of weakness within the axial cavity of the bullet.
Figure 32:
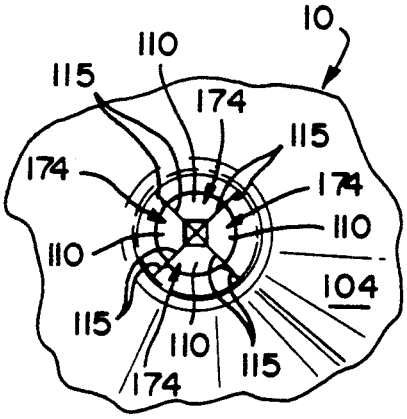
FIG. 32 is an enlarged top view looking downwardly in FIG. 21, and illustrates the reinforcing ribs and weakening lines, and the alternating relationship thereof.
Figure 33:
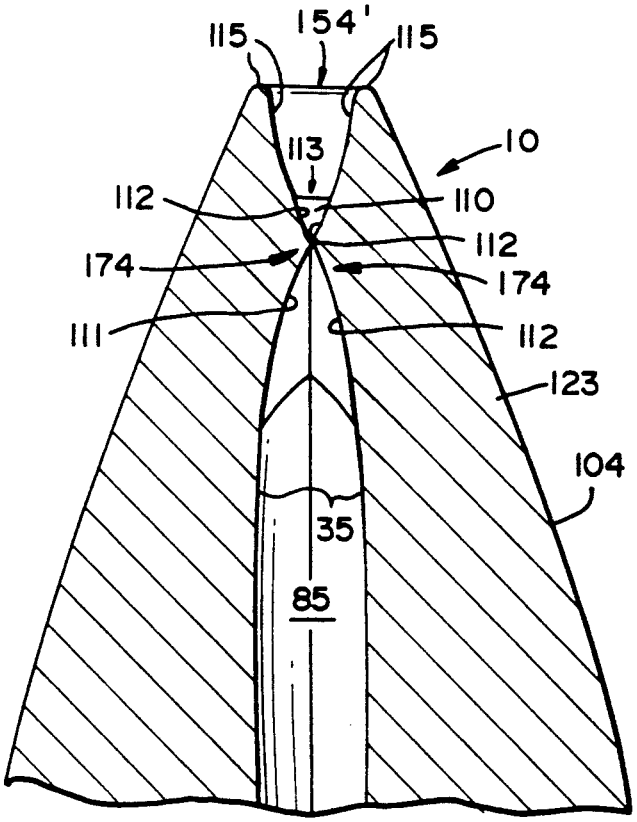
FIG. 33 is an enlarged fragmentary cross-sectional view taken generally along line 33—33 of FIG. 31, and illustrates details of the reinforcing ribs and weakening lines.

A novel, bullet component or projectile 10 constructed in accordance with this invention is illustrated in FIGS. 31 through 33, but reference will first be made to FIGS. 1 through 30 which schematically illustrate the preferred method of manufacturing the bullet 10.

The method of manufacturing the bullet 10 is preformed by conventional punch and die machinery, such as a Bliss Model No. 5012 punch and die machine manufactured by Bliss, Inc., 1004 East State Street, Hastings, Mich. 49058. The totality of the Bliss Model No. 5012 machine is incorporated hereat by reference, particularly since this and other conventional punch and die machines capable of performing the present method are well within the knowledge of a person skilled in the art, and the particular details of the apparatus form no part of the present invention. Suffice it to state that such conventional punch and die machines include a plurality of dies and associated cavities into which and from which workpieces are fed, worked upon, and ejected to progressively transform the initial workpiece into the final product.

A die 30 having a cylindrical cavity 31 is illustrated in FIG. 1 at an Insert and Calibration Station of a conventional punch and die machine, as aforesaid. A cylinderical punch 32 has an end face 33 which is in axial opposition to an end face 35 of a cylindrical eject stem 34. A slug 20 (FIGS. 1, 2 and 3) of homogeneous metallic material, such as copper 110, is inserted in the cavity 31 from above before punch 32 descends to the position shown in FIG. 1. The slug or bullet body 20 includes opposite axial circular end faces 21, 22 opposing the faces 33, 35 of the respective punch 32 and eject stem 34. The slug or bullet body 20 also includes an upper end portion 23, a lower end portion 24, and a cylindrical exterior surface 25. The slug or bullet body 20 is approximately 0.935 inch in length and 0.3000 (+0.0005) in diameter to produce a 30 caliber 150 grain bullet 10 (FIGS. 31–33).

The slug or bullet body 20 is initially cut from cylindrical copper stock material somewhat smaller in diameter than 0.3000 inch, and is thereafter conventionally formed in a punch and die similar to that shown in FIG. 1, but not illustrated, in which it is reduced in length and increased in diameter to that shown in FIG. 1. Thereafter the slug 20 is annealed, washed and then inserted into the die cavity 31. After the bullet body 20 has been inserted into the cavity 31, the punch 32 descends and eventually the surfaces 33, 21 and 22, 35 contact/bottom with the eject stem 34 at a predetermined position. The punch 32 is a calibration punch and functions merely to determine the correct (or incorrect) distance between the faces 21, 22 of the bullet body 20. The latter is determined by the descent of the punch 32 and the predetermined location of the face 35 of the eject stem 34. If the distance illustrated in FIG. 1 between the faces or surfaces 21, 33 and 22, 35, respectively, is within the tolerances of the 0.935 inch length required, the punch 32 subsequently retracts, the eject stem 34 moves upwardly, the bullet body 20 is ejected from the cavity 31, and moves on for subsequent processing. If, of course, the bullet body 20 is not of the proper length, it is ejected not only from the cavity 31 but from the machine proper and no subsequent work is performed thereon.

The bullet body 20 next moves to and is inserted in a die **30*a* having a cylindrical die cavity 31*a* (FIG. 4) at a First Punch Station which also includes a cylindrical eject stem 34*a* having an axial terminal face or a surface 35*a* axially opposing a punch 40 having a cylindrical portion or surface 41 and a generally pyramidal end portion 42 defined between a tip 43 and four curved edges 44. There are also four equally circumferentially spaced edges 45 spaced around the pyramidal portion 42 of the punch 40. Each adjoining pair of edges 45 define an apex 46 of four triangular faces or surface portions 47 which are each also defined by an associated one of the curved or arcuate edges 44. An appropriate force is applied to the punch 40 causing it to descend vertically downwardly during which the eject stem 34*a* is backed-up and held immobilized resulting in the formation of an axially outwardly opening cavity 26 in the axial end face or surface 21 of the bullet body 20 (FIGS. 5 and 6). The cavity 26 is, of course, formed into the mirror image of the pyramidal portion 42 of the punch 40 and particularly the apexes 46 thereof resulting in the cavity 26 being defined by four triangular surfaces or faces 27 merging at a blind end (unnumbered) and opposite thereto defining a peripheral edge 28 of a generally polygonal configuration. The angle Al (FIG. 4) of each triangular face 47 of the punch 40 to the vertical is preferably 15 degrees, though a range of 10–30 degrees is within the scope of the present invention, and thus like 15 degree angles are defined by the triangular faces or surfaces 27 relative to the axis A (FIG. 6) of the bullet body 20. The depth of the cavity 26 at the completion of the downward stroke of the punch 40, as shown in FIG. 4**, is approximately 0.200 inch.

The punch 40 is retracted and the eject stem 34*a* moves upwardly to eject the bullet body 20 from the cavity 30*a* after which the bullet body 20 is transferred to a Second Punch Station (FIG. 7) and inserted in a die cavity 31*b* of the die 30*b* into which is also reciprocated an eject stem 34*b* having an axial end or terminal face 35*b*. The eject stem 34*b* opposes and is in axial alignment with another punch 50 (FIGS. 7, 10 and 11).

The punch 50 includes a cylindrical portion or surface 51 and a terminal end or tip 52. A generally pyramidal portion 53 is set-off between the tip 52 and the cylindrical surface 51 with a line of demarcation between the cylindrical surface 51 and the pyramidal portion 53 being defined by an undulating or scalloped edge 54. The scalloped edge 54 is defined by two sets of convex edges 55, 56 disposed in alternating fashion about the circumference of the punch 50, and each adjacent pair of convex edges 55, 56 merges at an abrupt upwardly opening concave edge 58. A pair of edges 61, 62 converge downwardly from each concave edge 58 and merge at an associated apex or point 63 to define with the adjacent convex edge 56 a generally triangular face or portion 64. Each triangular face or portion 64 includes an angle A2 (FIG. 10) with the vertical or axis (unnumbered) of the punch 50 of approximately 9 degrees, although in keeping with the present invention a range of 5 degrees–15 degrees in contemplated. Thus there are four triangular faces or portions 64 equidistantly spaced about the circumference of the punch 50, and these alternate, at least in part, with four additional triangular faces or portions 74. Each triangular face or portion 74 is defined by one of the convex edges 55, a pair of the edges 61, 62 which are in diverging downward relationship relative to the triangular face or portion 74 bounded thereby, and an associated pair of downwardly converging pair of edges 72 between the tip 52 and the adjacent pair of associated apexes 63. The faces 74 preferably include an angle A2′ (FIG. 10) with the vertical or the axis (unnumbered) of the punch 50 of 18 degrees, but the latter may range between 15 degrees–30 degrees. Accordingly, between the tip 52 and the apexes 63 there are four edges 72 and the lower triangular end portions (unnumbered) of the generally triangular portion 74 below an imaginary line through the apexes 63 and normal to the axis of the punch 50, while above the latter imaginary line there are the four triangular faces 64 and the upper triangular portions (unnumbered) of the generally triangular faces 74, again above the imaginary line through the apexes 63 and normal to the axis of the punch 50. The relatively axial distances or heights D2, D2′ between the tip 52 and the apexes 63 and between the tip 52 and the bottom of the concave edges 58 are respectively 0.256 and 0.427 inch.

The punch 50 descends and applies a force of sufficient magnitude to reform the cavity or recess 26 of the slug 20 of FIGS. 5 and 6 into a reformed cavity or recess 75 (FIGS. 8 and 9) defined by four triangular surface portions or faces 76 equally spaced from each other and defined by adjoining edges 77 terminating at an upper peripheral edge 78 and merging at a blind end or apex 79. The depth of the cavity 75 is slightly less than the nominal axial distance D2. Accordingly, at the Second Punch Station the cavity 75 is formed strictly by the portion of the triangular faces 74 below the imaginary plane normal to the punch axis and passing through the apexes 63.

The punch 50 retracts, the eject stem 34*b* moves upwardly ejecting the reformed bullet body 20 from the cavity 31*b*, and the bullet body 20 is next advanced to and inserted in a cavity 31*c* of a die 30*c* of the Third Punch Station (FIG. 12) which includes an eject stem 34*c* having an axial end face 35*c* opposing another punch 50. The punch 50 at the Third Punch Station of FIG. 12 is identical to the punch 50 at the Second Punch Station (FIG. 7) and, thus, bears identical reference numerals. The punch 50 of FIG. 12 descends into the cavity 75 (FIGS. 8 and 9) of the reformed bullet body 20 now within the die cavity 31*c* under a sufficient magnitude of force to both axially lengthen the cavity 75 to form a new reformed cavity 85 which corresponds to and is generally a mirror image of the configuration of the entire pyramidal end portion 53 including the totality of each of the four triangular faces or portions 74 and the four triangular faces or portions 64. Since the reformed cavity 85 is transformed generally into a mirror image of the pyramidal portion 53 of the punch 50, numerals corresponding to those appearing on the punches 50 have been applied to the cavity 85, except the same have been primed. Accordingly, the cavity 85 includes an apex or blind end 52′, four edges 72′ extending between the apex 52′ and an associated one of the apexes 63′. Edges 61′, 62′ extend upwardly from each of the apexes 63′ and these each in turn merge with one of four concave outwardly opening edges or notches 56′. It is most significant to note that during the reforming of the bullet body 20 at the Third Punch Station, each edge 55′ of the bullet body 20 maintains a generally convex, though somewhat flattened configuration, as it formed between the associated triangular face 74, the adjacent edges 61, 62, and the convex edge 55 of the punch 50. It might well have been expected that between the edges 61, 62 of the punch 50 a like convex edge would be formed, but instead a concave edge 56′ is formed at and by each triangular face 64 between the edges 61, 62 of the punch 50. The latter apparent anomaly is believed to occur because as the punch 50 descends and the metal of the bullet body 20 extrudes axially upwardly, as viewed in FIG. 12, there is a circumferential stretching of the metal about the entire circumference of the punch 50 and the maximum circumferential stress/ tension is along four quadrants S (FIG. 13), each measured between the center of adjoining convex edges 55′. However, at the mid-point of each quadrant of highest stress S, there is located one of the triangular faces 64′ which functions to relieve these circumferential tension forces along the undulating edge 54 of the punch 50 during the descent thereof into the bullet body 20. Therefore, though the metal is extruded axially upwardly during the descent of the punch 50, the circumferential tensile forces S draw the metal immediately adjacent the undulating edge 54′ toward each of the relieved triangular faces 64′ creating the four axially outwardly opening notches 56′ with one notch 56′ being located at each triangular surface 64′ and generally bifurcated by a plane through the edge 72′ most adjacent thereto. Accordingly, at the completion of the descent of the punch 50 at the Third Punch Station, the upper undulating peripheral edge 54′ of the bullet body 20 is generally of a scalloped configuration defined by four relatively flat convex terminal edges 55' and four upwardly opening concave edges or notches 56', the latter being disposed in alternating fashion.

At the completion of the punching operation upon the bullet body 20 at the Third Punch Station, the punch 50 is retracted and eject stem 34c moves upwardly to eject the bullet body 20 from the cavity 31c of the die body 30c.

The bullet body 20 is then transferred to and is inserted into a die cavity 31d (FIG. 16) at a Fourth Punch Station of a die 30d into which is also reciprocated an eject stem 34d having an axial end or terminal face 35d. The eject stem 34d reciprocates in a cylindrical bore 31d' which merges through a radius portion 31d'' of the die cavity 31d. The eject stem 34d is in axial alignment with and opposes another punch 80 having a conical end portion 81 and a tip or end 82. The angle (unnumbered) of the conical end portion 81 is approximately 10 degrees to the axis of the punch 80, although the same may vary depending upon the angle A2' (FIG. 10) of the punch 50. The angle of the end portion 81 must be at all times smaller than the angle A2' of the punch 50 so that the interior surfaces of the reformed cavity 85 of the bullet body 20 at the completion of the third punch station operation are not materially altered or deformed upon the descent of the punch 80 (FIG. 16). As the punch 80 descends, its tip 82 bottoms in the apex or blind end 52' of the reformed cavity 85 and forces the bullet body 20 into conformity with the radius portion 31d'' of the cavity 31d thereby forming a generally rounded radius 86 adjacent and merging with the end or bottom 22 and the cylindrical body 25. In addition., the conical end portion 81 of the punch 80 compresses the metal of the bullet body 20 axially outwardly along the axial centers of the triangular faces 74' forming in each thereof a shallow exclamation point-shaped or teardrop-shaped recess 87. Thus, at the Fourth Punch Station the bullet body 20 is essentially rounded to form the rounded radius portion 86, the teardrop-shaped recess 87 is formed, and the overall length of the bullet body 20 is maintained within tolerance.

The punch 80 is subsequently retracted at the completion of the operation at the Fourth Punch Station, the eject stem 34d moves upwardly to eject the bullet body 20 from the cavity 31d, and thereafter the bullet body 20 is transferred to and inserted in a die cavity 31e of a die body 30e which includes a cylindrical bore 31e' into which is reciprocated an ejector stem 34e at a Coning Station (FIG. 19). A coning or female punch 90 is positioned in axial alignment with the axis of the die cavity 31e and the ejector stem 34e. The coning punch 90 also includes a cylindrical bore 91 in which is reciprocally mounted an ejector stem 92. The cylindrical bore 91 merges with means 95 for inwardly curving or coning the upper end portion 23 of the bullet body 20 during the downward descent of the punch 90 in the manner illustrated in FIG. 19 which transforms the upper end portion of the bullet body 20 from the configuration shown in FIG. 15 to the inwardly conical configuration of FIGS. 19 and 21. The coning means 95 includes a lead-in annular surface 96 of an approximate a generally concavely curved surface 97 of a relatively large radius (approximately R 1.96). The angle of the lead-in annular surface 96 is approximately 10 degrees and the maximum diameter thereof is approximately 0.350 (+0.001) to freely accommodate the entry of the end portion 23 of the bullet body 20 during the initial descent of the punch 90. Obviously, as the end portion 23 of the bullet body 20 and particularly the undulating edge 54' (FIG. 18) thereof moves inwardly along the concave surface 95, the metal of the undulating edge 54' and the end portion 23 is progressively compressed radially inwardly and the metal is thereby condensed, not folded or wrinkled, particularly in the area of the concave edges 56', the triangular portions 64' and the triangular portions 74' resulting in the partial closing of the reformed cavity 85 until the bullet body 20 has been contoured to the generally cone-shaped appearance of the end portion 23 thereof in FIGS. 20 and 21.

Figure 22:
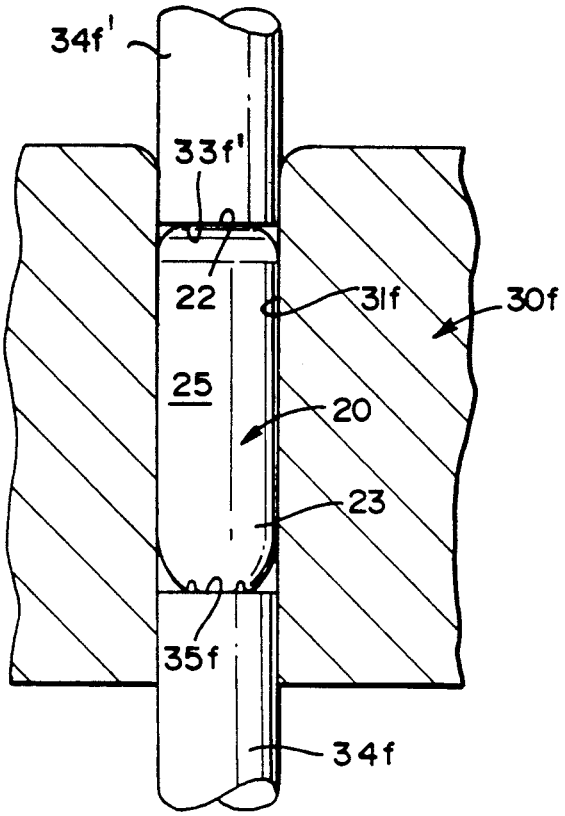
FIG. 22 is an enlarged fragmentary schematic view of another punch and die and the bullet body of FIGS. 20 and 21 after having been inserted therein at a reinsert station, and illustrates the inverted position of the bullet body relative to FIG. 19.

At the completion of the coning operation, the punch 90 is retracted and the ejector stem 92 initially remains generally in the position illustrated in FIG. 19 under the bias of a spring (not shown) to make certain that the bullet body 20 does not stick or jam in the means, concave surface or concavity 95. Subsequently, the ejector stem 34e moves upwardly and ejects the now coned bullet body 20 upwardly into an entrance end (not shown) of a conventional generally inverted U-shaped tube having a discharged end (not shown) adjacent an Insert Station (FIG. 22). Successive bullet bodies 20 are introduced into the inverted U-shaped tube and as each bullet body 20 is inserted into the input end a corresponding coned body 20 is discharged from the discharge end and is reinserted upside down or inverted at the Reinsert Station (FIG. 22) into a cavity 31f of a die body 30f. The die body 30f is a cylindrical bore into which is reciprocated from opposite ends a lower ejector stem 34f and an upper ejector stem 34f'. The ejector stems 34f, 34f' have respective terminal faces 35f and 33f, and these define a predetermined distance therebetween commensurate with the desired axial length of the bullet body 20 after the coning of the end portion 23 thereof at the Coning Station (FIG. 19). Thus, the ejector stem faces 35f, 33f function to measure/calibrate the axial length of the bullet body 20 and the same is discarded if it does not meet tolerances. Otherwise the Reinsert Station of FIG. 7 is an idle station at which no metal forming is performed within the die body 30f. At the completion of the calibration step at the Reinsert Station, the ejector stem 34f' is retracted, the ejector 34f moves upwardly, and the bullet body 20 is ejected and transferred to an Ogive Station (FIG. 23).

The bullet body 20 is inserted into a die cavity 31g of a die body 30g having a cylindrical bore 31g' in which is reciprocally mounted an ejector punch or stem 34g. The ejector punch 34g has an end face 35g which closes a bottom end of the die cavity 31g. The ejector stem 34g also opposes and is axially aligned with punch 34g' having an end face 33g. The die cavity 31g of the die body 30g includes a generally cylindrical surface 101 which merges with a progressively tapering ogive surface 102 which in turn merges at its narrowest end with the cylindrical bore or surface 31g'. When the coned bullet body 20 of FIG. 21 is initially positioned in the die cavity 31g, it readily descends to a point at which the end portion 23 approaches the area of merger (unnumbered) between the cylindrical surface 101 and the ogive surface 102. Thereafter,, the forceful descent of the punch 34g' results in the progressive deformation, compression and/or constriction of the metal of the bullet body 20 from that illustrated in FIGS. 20 and 21 to the more tapered projectile configuration of FIGS. 24 and 25 which corresponds generally to the configuration of the bullet 10 of FIGS. 31 through 33 which will be described more fully hereinafter. Essentially, the only difference between the bullet body 20 at the completion of formation at the Ogive Station (FIG. 23) and the bullet 10 of FIGS. 31 through 33 is the presence of a short axial cylindrical tip 103 (FIG. 24) of the bullet body 20 which is eventually profiled in a manner to be described more fully hereinafter. However, at the completion of the formation of the bullet body 20 at the Ogive Station of FIG. 23, the cavity 85 thereof is axially lengthened, appreciably radially reduced in cross-section over much of its length, an ogive surface 104 is formed at the upper end portion 23 thereof, and the metal within the cavity 85 generally adjacent the tip 103 is condensed and contoured into a particular configuration which defines a plurality of triangular interior surface portions within and in part defined by the cavity 85 which control the radial expansion of petals formed during bullet impact and expansion and also form a plurality of weakening means for controlling axial tearing of the petals during such bullet impact and expansion. These features will be more fully hereinafter described with respect to FIGS. 31 through 33, but the same are completely formed at the bottom stroke (FIG. 23) of the punch 34*g*' and the completion of the ogive step at the Ogive Station (FIG. 23).

Figure 23:
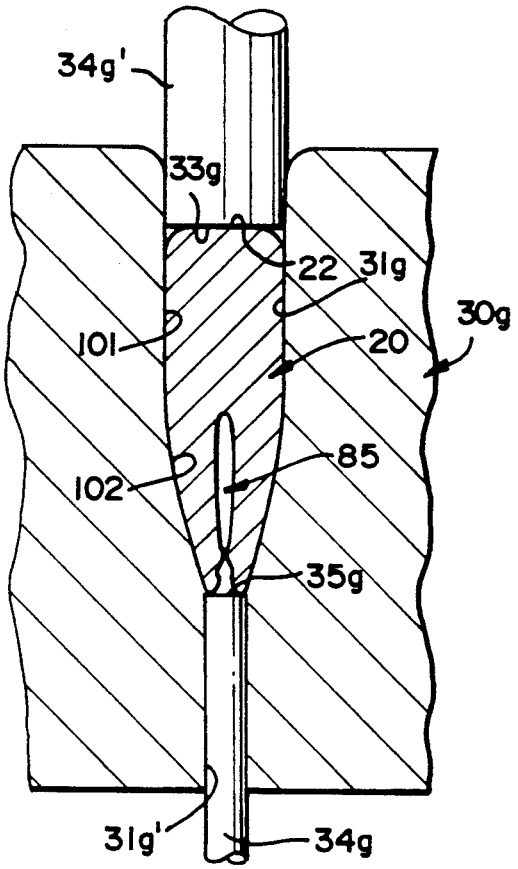
FIG. 23 is an enlarged fragmentary schematic view of a punch, die and the bullet body of FIG. 22, and illustrates a working position of the punch and die at which the bullet body of the FIG. 22 has been constricted further axially inwardly reducing the transverse cross-sectional size of the axial cavity and forming therewithin a pluraltiy of alternating and axially extending reinforcing ribs and lines of weakening substantially corresponding to those of the final bullet of FIGS. 31 through 33.
Figure 24:
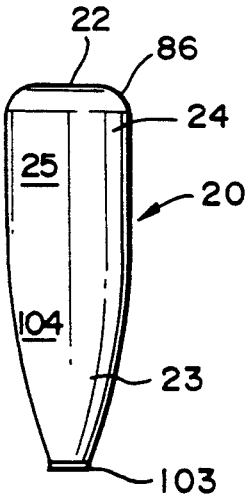
FIG. 24 is a side elevational view of the bullet body of FIG. 23.
Figure 25:
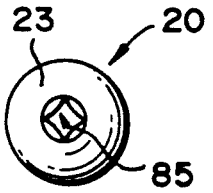
FIG. 25 is a plan view of the bullet body of FIG. 24 looking from bottom-to-top therein.
Figure 26:
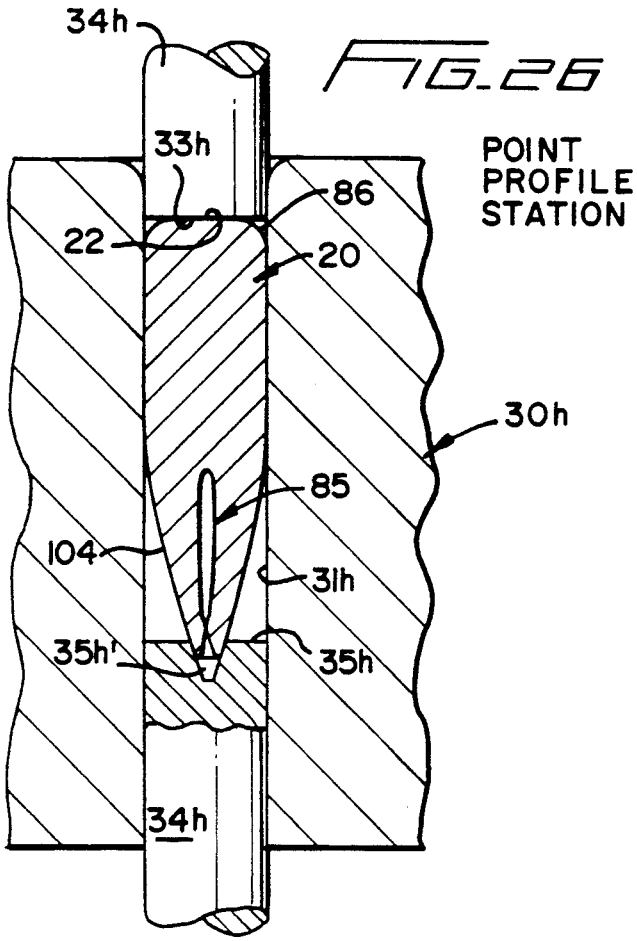
FIG. 26 is an enlarged fragmentary schematic view of another punch and die and the bullet body of FIGS. 24 and 25 transferred thereto at a point profile station, and illustrates a working position of the punch and die at which a point of the bullet is profiled and the exact configuration of the bullet of FIGS. 31 through 33 is completed including the final formation of the reinforcing ribs and weakening lines.
Figure 27:
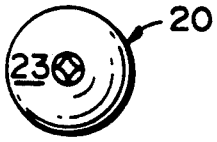
FIG. 27 is a top plan view of the bullet body of FIG. 28.
Figure 28:
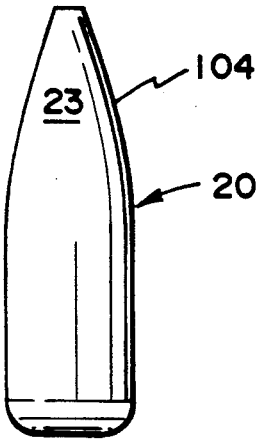
FIG. 28 is a side-elevational view of the bullet body of FIG. 27.

At the completion of the ogive step of FIG. 23, the punch 34*g*' is retracted and the ejector stem 34*g* is moved upwardly to eject the bullet body 20 from the die cavity 31*g* of the die body 30*g* and transfer the same to a die cavity 31*h* of a die body 30*h* at a Point Profile Station (FIG. 9).

The cavity 31*h* of the die 30*h* is cylindrical and receives therein an axially aligned ejector stem 34*h* having a terminal end face 35*h* through which opens a generally conical recess 35*h*' and a punch 34*h*' having a terminal face 33*h*. When the bullet body 20 is initially inserted into the die cavity 31*h*, the short axial cylindrical tip 103 (FIG. 24) is inserted slightly within the concial recess 35*h*'. As the punch 34*h*' forcefully descends downwardly, the magnitude of the force applied against the bullet 20 causes the tip 103 to conform to the recess 35*h*' resulting in the finally configured tip 105 (FIGS. 32 and 33) which essentially has an exterior surface defining a continuation of the ogive surface 104.

Figure 29:
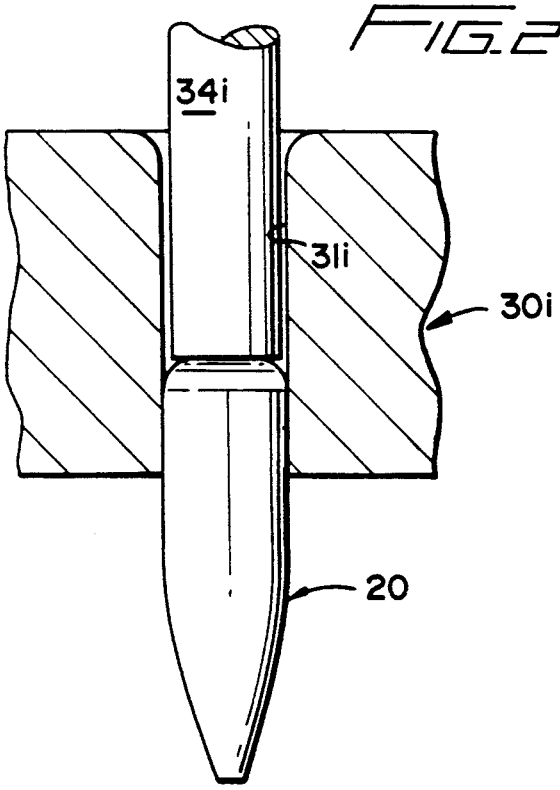
FIG. 29 is an enlarged fragmentary schematic view of a punch and die at a sizing station, and illustrates the bullet being sized prior to final canneluring, resizing and/or cleaning and polishing.
Figure 30:
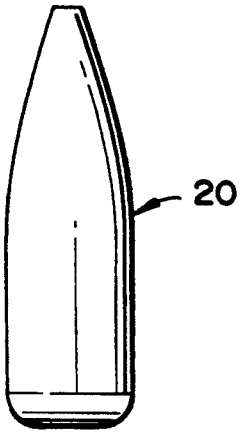
FIG. 30 is a side elevational view of the bullet of FIG. 29.

Upon the completion of the operation at the Point Profile Station, the punch 34*h*' is retracted, the ejector stem 34*h* moves upwardly ejecting the bullet body 20 from the die cavity 31*h*, and subsequently the same is transferred to a Sizing Station (FIG. 29).

The Sizing Station of FIG. 29 includes a die cavity 31*i* of a die body 30*i* into which the bullet body 20 is inserted. A lower ejector stem (not shown) corresponding to the ejector stem 34*f* of FIG. 22 opposes an upper ejector stem 34*i*, the function thereof being to accurately calibrate or size the length of the bullet or bullet body 20. The bullet body 20 is eventually bottom-ejected from the die cavity 31*i* during the descent of the ejector stem 34*i*, as shown in FIG. 29, and bullet bodies 20 within acceptable tolerances are subsequently conventionally cannelured, recalibrated or resized, cleaned and polished, resulting in the final bullet body or bullet 10 of FIGS. 31 through 33 with the canneluring thereof being generally designated by the reference numeral 107.

The final or finished bullet 10 of FIGS. 31 through 33 of the drawings includes the overall exterior and interior configuration heretofore described relative the the method of manufacture thereof, particularly the manner in which the cavity 85 achieves its final configuration when the bullet body 20 is operated upon at the Ogive Station of FIG. 23. As was earlier noted, the upper end portion 23 is forced inwardly to form the exterior ogive surface 104 and during this formation, the metallic material is compressed and condensed generally from the configuration thereof shown in FIG. 13 through 15 to that shown in FIGS. 31 through 33. As circumferentially inwardly directed forces act against the upper end portion 23 during the ogiving step of FIG. 23, these same forces cause the material in the area of the triangular surface portions 74' (FIG. 14) to flow or upset radially inwardly which transforms each of these surfaces 74' into means 174 in the form of four radially inwardly directed ribs. The ribs 174 (FIG. 32) are generally pie-shaped, as viewed from above, and each includes an upper surface or face 110, a lower surface or face 111 and an edge or point 112 at which the faces 110, 111 of each rib 174 merge. The upper triangular or pie-shaped faces 110 taper upwardly and radially outwardly from the edges 112 (FIG. 33) while the lower faces 111 are similarly triangularly shaped and taper radially outwardly and downwardly from the edges 112 (FIG. 33). The edges 112 are slightly spaced from each other and define a generally polygonal or square shaped opening 113 (FIG. 32) therebetween.

During the same condensation or compression of the metallic material of the bullet body 20 during the ogiving step, the metal at each notch 56' (FIG. 14), triangle 64' and edge 72' also compresses or condenses, but to a lesser extent than that of the material in the area of each triangular portion 74'. There is less condensation and compression of the metal in the area of each triangular portion 64' than in the area of each triangular portion 74' because there is less metal volume within each triangular portion 64' as compared to the volume of material within each triangular portion 74'. Therefore, upon the circumferential inward compression or condensation heretofore noted, the metal in the area 74' is extruded or forced radially inwardly forming the ribs 174; whereas the metal in the areas 64' is essentially circumferentially compressed without radial inward extrusion. This can be best visualized by imagining that the compression forces force the edges 61', 62' of each triangular portion 64' toward each other until these edges 61', 62' virtually merge with each other and become coplanar with the corresponding adjacent edge 72' (FIG. 32). This same movement essentially closes the notches 56' transforming the same into extremely tiny, barely visible to the naked eye radial slits with each slit 56' lying in a plane of the adjacent merged edges 61', 62' and the adjacent edge 72'. The latter components collectively define four axially extending weakening means, generally designated by the reference numeral 115, which are equally circumferentially spaced about the end portion 123 and extend from the now relatively flat peripheral edge 154' downwardly to the apex 52'. Thus, each pair of axial-extending weakening means or lines 115 set-off or bound one of the ribs 174. Accordingly, each weakening means 115 extends generally from the terminal peripheral edge 154 downwardly to the apex 52'. Due to this construction, the four ribs or means 174 control radial expansion of petals formed upon impact of the bullet 20 while the means 1.15 cooperate therewith to both limit circumferential and axial tearing of the petals during such expansion, as will be best described and visualized relative to FIGS. 34 through 36 of the drawings.

Upon impact, the cavity 85 of the bullet 10 pressurizes and this pressure eventually creates the hydraulic shock heretofore noted. Thus, upon such high pressurization internally of the cavity 85, eventually the forward or upper end portion 123 of the bullet 10 begins to tear much in the manner in which a tightly closed flower bud begins to open. The plurality of circumferentially spaced axial extending weakening means 115 controls such tearing therealong beginning at the terminal edge 154' where the cross-sectional thickness of the metal is the least and controls such progressive tearing axially downwardly until reaching the apex 52'. During this tearing along the four weakening means or lines 115, the metal in the area bounded by each rib 174 is progressively "unfolded" much in the manner of the petals of a flower, in an outward and downward direction forming essentially four petals 175 (FIG. 34) from the four ribs 74' of FIG. 13. In FIG. 34 there are two lead lines from each line of weakening 115 to designate that each line of weakening 115 has essentially been ruptured along its length from the terminal edge 154' to the apex 52', and this splitting or parting along weakening line 115 assures that the bullet does not fragment into pieces and that the petals 175 are formed of a generally regular configuration, both in axial cross-section (FIG. 35) and across the transverse cross-section (FIG. 36) of each petal 175 which is relatively uniform being thickest at a ridge or center line 176 thereof and tapering toward the opposite edges 115, 115. The material is thickest along the ridges 176 along the center of each petal 175 because these are the areas which correspond to the center of each of the ribs 174. Thus, as the cavity pressure ruptures the end portion 123 and "unfolds" the end portion 123, the areas of least resistance tear first, namely, along the weakening lines 115. Thus, each rib 174 assures that each petal 175 formed upon impact generally tapers radially outwardly from the bullet axis toward the end (unnumbered) of each petal 175, as shown in FIG. 35, and also tapers or reduces in thickness progressively from each ridge 176 toward the torn edges 115 associated with each petal 175, as shown in FIG. 36. By this controlled outward radial expansion of the petals 175 during impact and the controlled axial and radial tearing by the respective means 174 and 115 (FIG. 32), the bullet 10 advantageously meets the objectives of the invention noted earlier herein.

Another novel method of manufacture of a bullet in accordance with this invention will now be described relative to FIGS. 37, 40 and 43 and respective punches 140, 150, 150 and die bodies 130*a*, 130*b*, and 130*c* thereof. The punches and die bodies of FIGS. 37, 40 and 43 correspond respectively to the operations performed in the first described embodiment of the invention at the First Punch Station (FIG. 4), the Second Punch Station (FIG. 7) and the Third Punch Station (FIG. 12). Other than the operations performed at the stations of FIGS. 37, 40 and 43, the other operations which are not illustrated correspond identically to those described relative to the first embodiment of the invention.

The second embodiment of the invention is also performed by the conventional punch and die machinery earlier described upon a slug or bullet body 120 which, prior to the operation at the First Punch Station, includes opposite axial circular end faces 121, 122, the former of which initially has no cavity therein, upper and lower end portions 123, 124, respectively, and a cylindrical exterior surface 125. After calibration, corresponding to the operation performed by the die 30 and the punches 323 34 of FIG. 1, the slug or bullet body 120 is inserted into a die cavity 131*a* of the die 130*a* prior to the descent of the punch 140. A cylindrical eject stem 134*a* having an axial terminal face or surface 135*a* opposes the punch 140 which includes a conical end portion 142 having a tip 143. The angle of the conical portion 141 is preferably 15 degrees, though a range of 10–30 degrees is within the scope of the present invention. An appropriate force is applied to the punch 140 causing it to descent forcefully, vertically downwardly during which time the eject stem 134*a* is backed-up and held immobile. The latter results in the formation of an axially outwardly opening conical cavity 126 in the axial end face 121 of the bullet body 120. The depth of the cavity 126 at the completion of the downward stroke of the punch 140 is approximately 0.200 inch.

The punch 140 is retracted and the eject stem 134*a* ejects the bullet body 120 from the cavity 131*a* after which the bullet body 120 is transferred to i Second Punch Station (FIG. 40) and inserted into a die cavity 131*b* of a die 130*b* into which is also reciprocated an eject stem 134*b* having an axial end or terminal face 135*b*. The eject stem 134*b* opposes and is in axial alignment with the punch 150.

The punch 150 includes a cylindrical portion or surface 151 and a terminal end or tip 152 and is generally contoured to the configuration of the punch 40 of FIG. 4. A generally pyramidal portion 153 is set-off between the tip 152 and the cylindrical surface 151 with a line of demarcation between the cylindrical surface 151 and the pyramidal portion 153 being defined by an undulating or scalloped edge 154. The scalloped edge 154 is defined by four convex edges 156 disposed in alternating fashion about the circumference of the punch 150, and between each pair of adjacent convex edges 156 is an abruptly upwardly opening concave edge 158. Four edges 161 converge downwardly from each concave edge 158 and merge at an associated apex portion 163 to define with the adjacent convex edge 156 a generally triangular face or portion 164. Each triangular face or portion 164 includes an angle corresponding in range between the angle A1 and the angle A2' of the punches of FIGS. 4 and 10, respectively. Thus, there are four triangular faces or portions 164 equidistantly spaced about the circumference of the punch 150.

The punch 150 descends and applies a force of sufficient magnitude to reform the cavity or recess 126 of the slug or bullet body 120 of FIGS. 38 and 39 into a reformed cavity or recess 275 defined by four triangular surface portions or faces 276 equally spaced from each other and defined by adjoining edges 277 terminating in an upper peripheral edge 278 and merging at a blind end or apex 279 (FIGS. 41 and 42). The depth of the cavity 275 is slightly less than the nominal axial distance D2 (FIGS. 7 and 10). Accordingly, at the Second Punch Station (FIG. 40) the cavity 275 is formed strictly by the apex portions 163 of the triangular faces 164.

The punch 150 retracts, the eject stem 134*b* moves upwardly ejecting the reformed bullet body 120 from the cavity 131*b*, and the bullet body 120 is next advanced to and inserted in a cavity 131*c* of a die 130*c* of a Third Punch Station (FIG. 43) which includes an eject stem 134*c* having an axial end face 135*c* opposing another punch 150. The punch 150 at the Third Punch Station (FIG. 43) is identical to the punch 150 at the Second Punch Station (FIG. 40) and, thus, bears identical reference numerals. The punch 150 of FIG. 43 descends into the cavity 275 (FIGS. 41 and 42) of the reformed bullet body 20 now within the die cavity 131*c* under a sufficient magnitude of force to both axially lengthen the cavity 275 and to form a new reformed cavity 285 which corresponds to and is generally a mirror image of the configuration of the entire pyramidal end portion 153 of the punch 150 including the totality of each of the four triangular faces or portions 164. Since the reform cavity 285 is transformed generally into a mirror image of the pyramidal portion 153 of the punch 150, numerals corresponding to those appearing on the punches 150 have been applied to the cavity 285, except the same have been primed.

Accordingly, the cavity 285 includes an apex or blind end 152', four edges 161' extending between the apex 152' and the undulating edge 154' merging one each with the four concave outwardly opening edges or notches 158'. As earlier noted, it is most significant to note that during the reforming of the bullet 120 at the third punch station (FIG. 43), each edge 156' of the bullet body 120 maintains a generally convex, though somewhat flattened configuration, as it is formed between the associated triangular face 164, the adjacent edge 156 and the apex 152 of the punch 150. Accordingly, at the completion of the descent of the punch 150 at the third punch station (FIG. 43), the upper undulating peripheral edge 154' is generally of a scalloped configuration defined by four relatively flat convex terminal edges 156' and four upwardly opening concave edges or notches 158', the latter being disposed in alternating fashion.

At the completion of the punching operation upon the bullet 120 at the third punch station (FIG. 43), the punch 150 is retracted and the eject stem 134*c* moves upwardly to eject the bullet body 120 from the cavity 131*c* of the die body 130*c*.

The bullet body 120 is then transferred to, inserted into, and operated upon in the manner heretofore described relative to FIGS. 16, 19, 22, 23, 26 and 29, although the operation at the Fourth Punch Station (FIG. 16) can be eliminated. Hence, the bullet body 120 of FIGS. 44 and 45 need not include the exclamation point-shaped or teardrop-shaped recess 87 (FIG. 18), but upon the final operation, the configuration of the bullet is as shown in FIGS. 47 and 48, again with several reference numerals being applied thereto corresponding to those appearing in FIGS. 31 through 33, though appropriately primed, as necessary, to illustrate identical bullet structure. The bullet body 120 thereby includes four axially extending weakening means, generally designated by the reference number 115', which are equally circumferentially spaced about the end portion 123 and extend from the now relatively flat peripheral edge 154' downwardly to the apex 152' (46). Thus each pair of axially extending weakening means or lines 115' set-off or bound one of the ribs 174'. Accordingly, each weakening means 115' extends generally from the terminal peripheral edge 154' downwardly to the apex 152'. Just as in the case of the bullet 10 (FIGS. 31 through 33), the four ribs or means 174' control radial expansion of petals formed upon impact of the bullet 120 while the means 115' cooperate therewith to both limit circumferential and axial tearing of the petals during such expansion, as has been earlier described relative to FIGS. 31 through 33 and is incorporated hereat by reference.

Since the bullet 120 operates identically to the bullet 10 upon impact and subsequent mushrooming thereof, such earlier description relative to the bullet 10 is also incorporated hereat by reference.

Characteristically of each of the bullets 10, 120 is the fact that when viewed from the top (FIGS. 32 and 47), each has a characteristic "X" defined by the weakening lines 115, 115' radiating from the opening 113. Thus, the bullet has been tradenamed the "X-Bullet."

Although a preferred embodiment of the invention has been specifically illustrated and described herein, it is to be understood that minor variations may be made in the method and apparatus without departing from the spirit and scope of the invention, as defined in the appended claims.

I claim:

1. An intermediate article used to form a bullet projectile consisting essentially of a single member formed from a single piece of material defined by axially opposite first and second end portions terminating in respective first and second ends, said first end defining a bottom of said bullet projectile and said second end defining a top thereof, a cavity in said second end portion opening in a direction toward said second end, said second end defining a terminal peripheral edge of said cavity, said terminal peripheral edge being of an undulating configuration, said undulating terminal edge being defined by alternating generally axially upwardly opening concave edge portions and axially upwardly curved convex edge portions, said second end portion also being of a generally outwardly convex configuration converging in a direction toward said second end, and said single member being subject to high pressurization within said cavity upon high velocity object impact whereby said second end portion tears to form petals which impart a mushroom configuration to a finally formed bullet projectile.

2. The intermediate article used to form a bullet projectile as defined in claim 1 wherein said cavity is defined by a plurality of interior surface portions each of a generally triangular configuration, each triangular interior surface portion includes an apex, and said apices generally merge toward a blind end of said cavity.

3. The intermediate article used to form a bullet projectile as defined in claim 1 wherein said cavity is defined by a plurality of interior surface portions each of a generally triangular configuration, each triangular interior surface portion includes an apex, said apices generally merge toward a blind end of said cavity, and each triangular interior surface portion is generally set-off by a pair of converging edges merging at an associated apex and one of said convex edge portions.

4. The intermediate article used to form a bullet projectile as defined in claim 1 wherein said cavity is defined by a plurality of interior surface portions each of a generally triangular configuration, each triangular interior surface portion includes an apex, said apices generally merge toward a blind end of said cavity, and each triangular interior surface portion is generally set-off by a pair of converging edges merging at an associated apex and one of said convex edge portions, and each converging edge terminates at an associated one of said concave edge portions.

5. The intermediate article used to form a bullet projectile as defined in claim 1 wherein said second end portion includes a terminal edge portion deformed inwardly toward a longitudinal axis of said cavity.

6. An intermediate article used to form a bullet component consisting essentially of a single member formed from a single piece of material defined by axially opposite first and second end portions terminating in respective first and second ends, said first end defining a bottom of said bullet component and said second end defining a top thereof, a cavity in said second end portion opening in a direction toward said second end, said second end defining a terminal peripheral edge of said cavity, said terminal peripheral edge being of an undulating configuration, said undulating terminal edge being defined by alternating generally axially upwardly opening concave edge portions and axially upwardly curved convex edge portions, said second end portion also being of a generally outwardly convex configuration, said cavity being defined by a plurality of interior surface portions each of a generally triangular configuration, a first of said triangular interior surface portions each being defined by a first pair of edges each defining a first apex, said first apices merging and defining a blind end of said cavity remote from said undulating terminal edge, a second of said triangular interior surface portions each being defined by a second pair of edges each defining a second apex, and each first triangular interior surface portion being set-off by one of said convex edge portions.

7. An intermediate article used to form a bullet component consisting essentially of a single member formed from a single piece of material defined by axially opposite first and second end portions terminating in respective first and second ends, said first end defining a bottom of said bullet component and said second end defining a top thereof, a cavity in said second end portion opening in a direction toward said second end, said second end defining a terminal peripheral edge of said cavity, said terminal peripheral edge being of an undulating configuration, said undulating terminal edge being defined by alternating generally axially upwardly opening concave edge portions and axially upwardly curved convex edge portions, said second end portion also being of a generally outwardly convex configuration, said cavity being defined by a plurality of interior surface portions each of a generally triangular configuration, a first of said triangular interior surface portions each being defined by a first pair of edges each defining a first apex, said first apices merging and defining a blind end of said cavity remote from said undulating terminal edge, a second of said triangular interior surface portions each being defined by a second pair of edges each defining a second apex, and each second triangular interior surface portion being set-off by one of said convex edge portions.

8. An intermediate article used to form a bullet component consisting essentially of a single member formed from a single piece of material defined by axially opposite first and second end portions terminating in respective first and second ends, said first end defining a bottom of said bullet component and said second end defining a top thereof, a cavity in said second end portion opening in a direction toward said second end, said second end defining a terminal peripheral edge of said cavity, said terminal peripheral edge being of an undulating configuration, said undulating terminal edge being defined by alternating generally axially upwardly opening concave edge portions and axially upwardly curved convex edge portions, said second end portion also being of a generally outwardly convex configuration, said cavity being defined by a plurality of interior surface portions each of a generally triangular configuration, a first of said triangular interior surface portions each being defined by a first pair of edges each defining a first apex, said first apices merging and defining a blind end of said cavity remote from said undulating terminal edge, a second of said triangular interior surface portions each being defined by a second pair of edges each defining a second apex, and each first triangular interior surface portion being set-off by one of said convex edge portions, and each second triangular interior surface portion being set-off by one of said concave edge portions.

9. An intermediate article used to form a bullet component consisting essentially of a single member formed from a single piece of material defined by axially opposite first and second end portions terminating in respective first and second ends, said first end defining a bottom of said bullet component and said second end defining a top thereof, a cavity in said second end portion opening in a direction toward said second end, said second end defining a terminal peripheral edge of said cavity, said terminal peripheral edge being of an undulating configuration, said undulating terminal edge being defined by alternating generally axially upwardly opening concave edge portions and axially upwardly curved convex edge portions, said second end portion also being of a generally outwardly convex configuration, said cavity being defined by a plurality of interior surface portions each of a generally triangular configuration, a first of said triangular interior surface portions each being defined by a first pair of edges each defining a first apex, said first apices merging and defining a blind end of said cavity remote from said undulating terminal edge, a second of said triangular interior surface portions each being defined by a second pair of edges each defining a second apex, and each first triangular interior surface portion being set-off by one of said convex edge portions, and each edge of said first pair of edges merges with a second apex of an associated one of said second triangular interior surface portions.

10. An intermediate article used to form a bullet component consisting essentially of a single member formed from a single piece of material defined by axially opposite first and second end portions terminating in respective first and second ends, said first end defining a bottom of said bullet component and said second end defining a top thereof, a cavity in said second end portion opening in a direction toward said second end, said second end defining a terminal peripheral edge of said cavity, said terminal peripheral edge being of an undulating configuration, said undulating terminal edge being defined by alternating generally axially upwardly opening concave edge portions and axially upwardly curved convex edge portions, said second end portion also being of a generally outwardly convex configuration, said cavity being defined by a plurality of interior surface portions each of a generally triangular configuration, each triangular interior surface portion includes an apex, said apices generally merge toward a blind end of said cavity, and each triangular surface portion includes a relatively shallow concave surface opening toward a longitudinal axis of said cavity.

11. A bullet projectile consisting essentially of a generally elongated one-piece body defined by an exterior surface and axially opposite first and second end portions having respective first and second ends, said first end defining a bottom of said one-piece body and said second end defining a top thereof, an axial cavity in said second end portion having a blind end, said axial cavity being defined by an interior surface at said second end portion, said top including a generally annular terminal edge between said interior and exterior surfaces, said interior and exterior surfaces defining a second end portion wall generally reducing in wall thickness in a direction away from said blind end, a plurality of radially inwardly projecting circumferentially adjacent and longitudinally extending means disposed along an inner peripheral portion of said cavity below said annular terminal edge and above said blind end constricting the radial size of said cavity for controlling radial expansion of petals formed during bullet projectile impact and expansion, and a plurality of circumferentially spaced axially extending weakening means disposed one each between said radial expansion controlling means and extending to said annular terminal edge along said interior surface for controlling axial tearing of the petals during bullet projectile impact and expansion.

12. The bullet projectile as defined in claim 11 wherein each of said means for controlling petal radial expansion is a generally radially inwardly directed rib.

13. The bullet projectile as defined in claim 11 wherein each of said means for controlling petal axial tearing is a generally axially extending line of weakening.

14. The bullet projectile as defined in claim 11 wherein each of said means for controlling petal radial expansion is a generally radially inwardly directed rib, and said ribs are generally of a triangular cross sectional configuration relative to a plane normal to the bullet body axis.

15. The bullet projectile as defined in claim 11 wherein each of said means for controlling petal radial expansion is a generally radially inwardly directed rib, and each of said means for controlling petal axial tearing is a generally axially extending line of weakness.

16. The bullet projectile as defined in claim 11 wherein said second end portion is of a generally outwardly convex configuration.

* * * * *